US007441814B2

(12) United States Patent
Ponn et al.

(10) Patent No.: US 7,441,814 B2
(45) Date of Patent: Oct. 28, 2008

(54) VEHICLE LOCK DEVICE

(75) Inventors: Helmut Ponn, Torslanda (SE); Stig Hermansson, Kungälv (SE)

(73) Assignee: Volvo Car Corporation, Gothenburg (SE)

( * ) Notice: Subject to any disclaimer, the term of this patent is extended or adjusted under 35 U.S.C. 154(b) by 0 days.

(21) Appl. No.: 09/683,233

(22) Filed: Dec. 4, 2001
(Under 37 CFR 1.47)

(65) Prior Publication Data

US 2003/0057716 A1 Mar. 27, 2003

Related U.S. Application Data

(63) Continuation of application No. PCT/SE00/00890, filed on May 5, 2000.

(30) Foreign Application Priority Data

Jun. 4, 1999 (SE) ..... 9902092

(51) Int. Cl.
*E05C 3/06* (2006.01)
*E05C 3/16* (2006.01)

(52) U.S. Cl. ..... 292/216; 292/201; 292/DIG. 42

(58) Field of Classification Search ..... 292/201, 292/216, 125, 133, 225, 235, DIG. 25, 336.3, 292/DIG. 23, DIG. 42; 74/500.5, 502.5
See application file for complete search history.

(56) References Cited

U.S. PATENT DOCUMENTS 2,877,038 A * 3/1959 Kramer ..... 292/216
2,924,473 A * 2/1960 Krause ..... 292/11
2,989,333 A * 6/1961 Fox ..... 292/280
3,572,791 A * 3/1971 Foley ..... 292/216
3,572,793 A * 3/1971 Cole ..... 292/216
3,788,438 A * 1/1974 Reno ..... 192/110 R
3,905,624 A * 9/1975 Fujita ..... 292/11

(Continued)

FOREIGN PATENT DOCUMENTS

DE 9311377 U1 11/1993

(Continued)

OTHER PUBLICATIONS

International Search Report for International Patent Application PCT/SE2000/00890, dated Sep. 11, 2000.

*Primary Examiner*—Carlos Lugo
(74) *Attorney, Agent, or Firm*—Novak Druce + Quigg LLP

(57) ABSTRACT

The present invention discloses a vehicle lock device that can be shifted between a locked position and an unlocked position. The vehicle lock includes a lock casing and a cable sheath fixed in relation to the lock casing and in which a cable is displaceably arranged. The end of the cable pointing to the lock casing is designed, by pushing down the other end of the cable in the cable sheath, to be brought into engagement with a cable seat. The cable seat is operatively connected to a catch for actuation of the catch. By actuating the catch, it is disengaged from a rotary bolt, thereby releasing the bolt. In the lock casing there is an element designed to act upon the cable end pointing towards the lock casing. By doing so, the cable end is directed for engagement with the cable seat in the unlocked position, and is directed to the side of the cable seat in the locked position.

13 Claims, 2 Drawing Sheets

U.S. PATENT DOCUMENTS 4,374,597 A * 2/1983 Mochida ..... 292/8
4,599,912 A * 7/1986 Barnard et al. ..... 74/500.5
4,616,862 A * 10/1986 Ward ..... 292/201
4,643,470 A * 2/1987 Kazuyuki et al. ..... 292/216
4,691,584 A * 9/1987 Takaishi et al. ..... 74/471 R
4,906,035 A * 3/1990 Nagai et al. ..... 292/201
4,974,885 A * 12/1990 Yokoyama ..... 292/201
5,118,146 A * 6/1992 Watanuki ..... 292/216
5,348,355 A * 9/1994 Oyha ..... 292/11
5,445,421 A * 8/1995 Ferrara ..... 292/216
5,611,580 A * 3/1997 Choi ..... 292/164
5,618,069 A * 4/1997 Konchan et al. ..... 292/216
5,642,636 A * 7/1997 Mitsui ..... 70/237
5,738,394 A * 4/1998 Arabia et al. ..... 292/216
6,050,619 A * 4/2000 Arabia et al. ..... 292/216
6,053,542 A * 4/2000 Ostrowski et al. ..... 292/201
6,070,921 A * 6/2000 Valasin ..... 292/216
6,092,845 A * 7/2000 Koenig ..... 292/225
6,158,788 A * 12/2000 Ikeda et al. ..... 292/216

FOREIGN PATENT DOCUMENTS

DE 4406236 A1 8/1995
EP 0171313 A1 2/1986
EP 0805248 A2 11/1997
WO WO 9831904 A1 7/1998

* cited by examiner

VEHICLE LOCK DEVICE

CROSS REFERENCE TO RELATED APPLICATIONS

The present invention is a continuation of International Application No. PCT/SE00/00890, filed May 5, 2000, which claims priority to Swedish Application No. 9902091-9, filed Jun. 4, 1999. Both applications are expressly incorporated herein by reference.

BACKGROUND OF INVENTION

1. Technical Field

The present invention relates to a vehicle lock device. More specifically, the invention relates to a vehicle lock device which can be shifted between a locked position and an unlocked position by means of a cable that engages with a cable seat, thereby disengaging a rotary bolt from a catch.

2. Background Information

Vehicle locks wherein an opening force is transmitted to a catch by means of a bar are known. In such locks, the lock is usually fixed to a reversing arm. A mechanical operating device is designed to impart a torsional movement about its axis between a locked position and an unlocked position. In the unlocked position, the bar is directed towards a seat arranged for releasing the catch. In the locked position, the bar is directed alongside the seat. By realigning a rigid bar, forces occur when the bar is secured in the reversing arm. Such forces can generate torque that counteracts the torsion of the reversing arm between the locked and unlocked positions. These forces can be large and can occur, in particular, in the context of a collision, when vehicle deformation adjacent to the lock devices can mean that the opening function is jeopardized as a result of undue displacement or deformation of the bar. The forces can be so great that they cannot be overcome by the mechanical operating device so that the locking and unlocking function is impaired.

Accordingly, there is a need for a vehicle lock wherein the opening function of the lock can still occur, even in the event of an impact adjacent to the lock.

SUMMARY OF INVENTION

The present invention provides a vehicle lock device that eliminates, or at least reduces the problem described above. According to one embodiment of the present invention, a vehicle lock device is provided that can be shifted between a locked position and an unlocked position. The lock device includes a lock casing, a cable sheath fixed in relation to the lock casing, a cable displaceably arranged in the lock casing, and a cable seat operatively connected to a catch for actuation of the catch. One end of the cable points towards the lock casing. By pushing down the other end of the cable, the end pointing towards the lock casing engages with a cable seat. The cable seat is operatively connected to a catch. When the cable end engages the cable seat, the catch is disengaged from a rotary bolt, thereby releasing the bolt. In the lock casing there is an element designed to act upon that cable end so that in the unlocked position, the end is directed for engagement with the cable seat, and in the locked position, the end is directed towards the side of the cable seat.

Preferred embodiments furthermore have any or some of the characteristics specified in the subordinate claims.

BRIEF DESCRIPTION OF DRAWINGS

The invention will be explained in more detail below with the aid of the attached figures, which illustrate examples of embodiments of the device according to the present invention, wherein:

FIGS. 1*a* and 1*b* show general sketch drawings of one embodiment of the device according to the invention in a vehicle lock 1. The vehicle lock includes a lock casing 2 in which the other parts of the lock are arranged. The figure shows only those parts that are relevant to the invention.

DETAILED DESCRIPTION

Figure 1A:
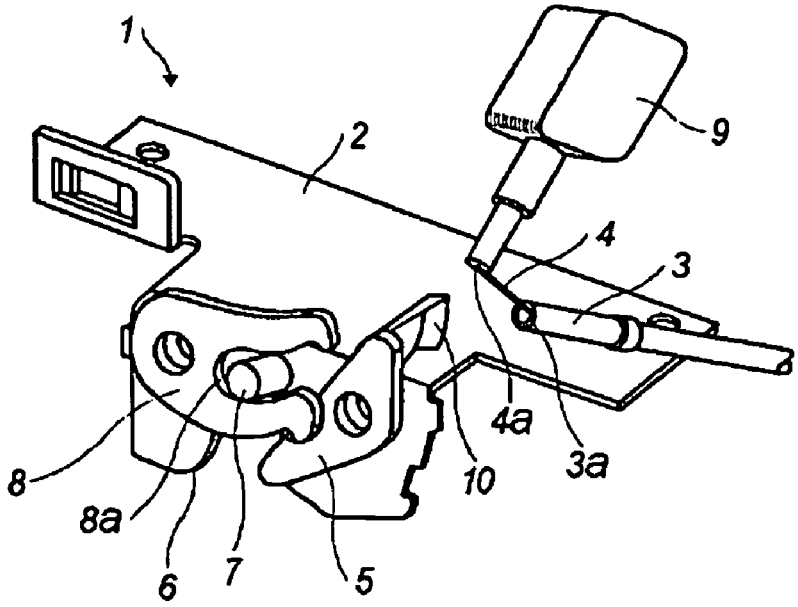
FIGS. 1*a* and 1*b* are perspective views illustrating the relative positioning between a cable end and a cable seat to convert a lock according to the present invention from a locked condition to an unlocked condition.

As illustrated, a cable sheath 3 is fixed in relation to the lock casing 2. A cable 4 is displaceably arranged in the cable sheath 3. A free cable end 4*a* protrudes from that end 3*a* of the cable sheath 3 fixed in relation to the lock casing 2 and points towards the lock casing 2. The other end of the cable 4 (not shown) may be designed to be pushed down into the cable sheath 3, for example, when acted upon by a door handle or some other operating device for opening the door.

The vehicle lock 1 also includes a catch 5 rotatably arranged in connection with an elongated recess 6 in the lock casing 2. The elongated recess 6 in the lock casing 2 is designed to receive a lock pin 7 that can be arranged, for example, on an openable part of the vehicle such as a door. On the opposite side of the elongated recess 6 a rotary bolt 8 with a recess 8*a* designed to receive the lock pin 7 is rotatably arranged in connection with the elongated recess 6. In the position shown, the rotary bolt 8 is engaged with the catch 5. This position is for preventing the lock pin 7, when it is in the recess 8*a* of the rotary bolt, from leaving the elongated recess 6 in the lock casing 2, thereby keeping the openable part of the vehicle locked in the vehicle.

Figure 1B:
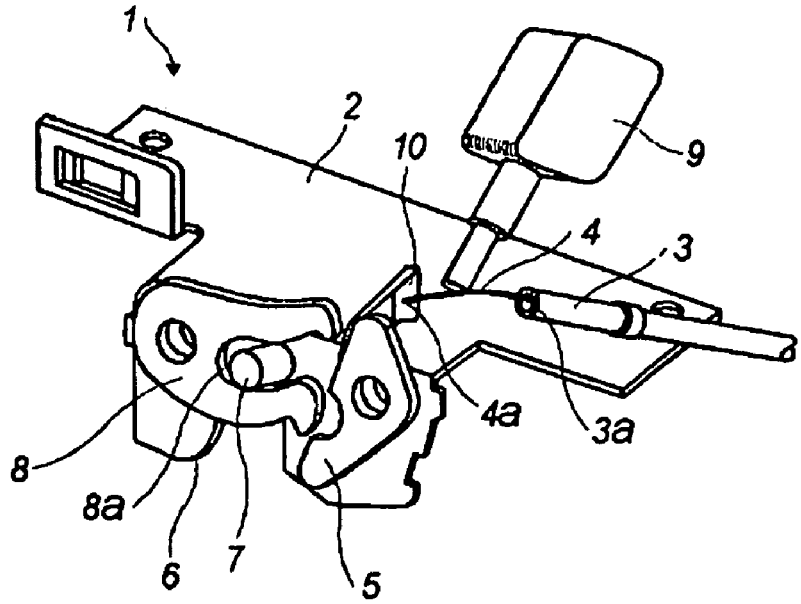

Next to that free end 4*a* of the cable pointing towards the lock casing 2 is an operating device 9 such as a mechanical operating device. This operating device 9 is designed, when shifted by the vehicle lock 1 from a locked position as in FIG. 1*a* to an unlocked position as in FIG. 1*b*, to position the free cable end 4*a* of the cable sheath 3 so that the free cable end 4*a* in the unlocked position is directed for engagement with a cable seat 10 arranged in the catch 5. The cable seat 10 may also be formed on a movable part operatively connected to the catch 5. As the cable 4 is further displaced, the cable seat 10 will take up the free end 4*a* of the cable and impart a torsional movement to the catch 5. The catch 5 is disengaged from the rotary bolt 8, thereby releasing the bolt. With the operating device 9 in the locked position, the free end 4*a* of the cable pointing towards the lock casing 2 or the cable sheath 3 is designed to assume an orientation wherein the cable end 4*a* is directed to the side of the cable seat 10 when it is forced out of that end 3*a* of the cable sheath directed towards the lock casing 2. For example, this can occur when acted upon by a door handle for pushing down the other end of the cable in the cable sheath 3. Since the cable seat 10 is not acted upon, the catch 5 and, hence, the rotary bolt 8 remain unaffected. The lock pin 7 of the openable part of the vehicle remains locked in the elongated recess 6 of the lock casing 2.

Figure 2A:
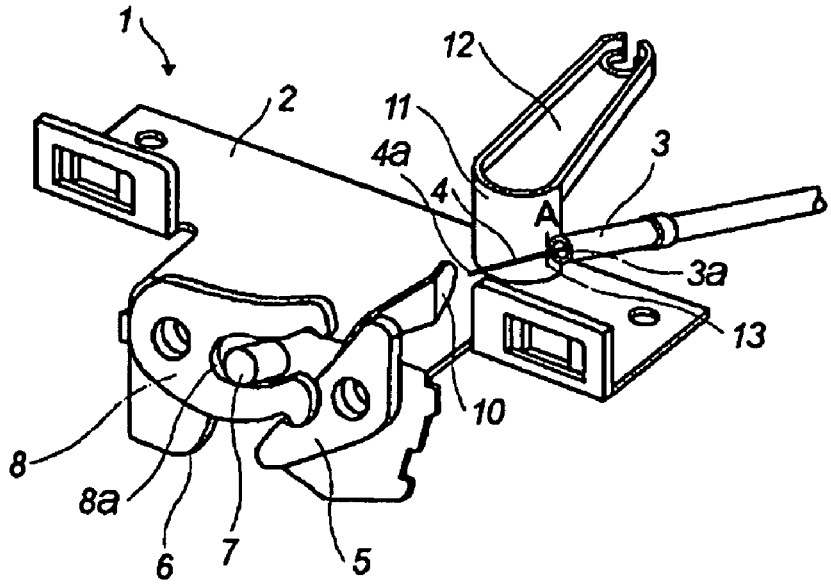
FIG. 2*a* and 2*b* are perspective views of another embodiment of the present invention illustrating how an operating device can used to position a cable end for separation from or engagement with a cable seat in a catch by way of a reversing arm and an actuating element for the cable end arranged therein.
Figure 2B:
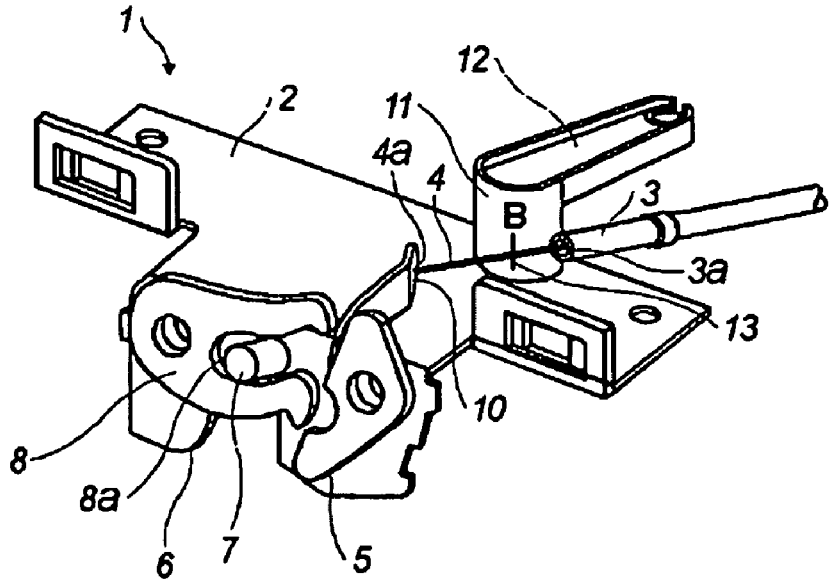

FIGS. 2*a* and 2*b* shows general sketch drawing of an alternative embodiment of the device in a vehicle lock 1. The vehicle lock 1 includes a lock casing 2 in which the other parts of the lock are arranged. The figure shows only those parts that are relevant to the invention.

A cable sheath 3 is fixed in the lock casing 2. A cable 4 is displaceably arranged in the cable sheath 3. A free cable end 4*a* protrudes from that end 3*a* of the cable sheath fixed in the lock casing and points towards the lock casing 2. The other end of the cable 4 (not shown) may be designed to be pushed down into the cable sheath 3, for example, when acted upon by a door handle or some other operating device for opening the door.

The lock 1 includes a catch 5 rotatably arranged in connection with an elongated recess 6 in the lock casing 2. The elongated recess 6 is designed to receive a lock pin 7. The lock pin 7 can be arranged, for example, on an openable part of the vehicle such as a door. On the opposite side of the elongated recess a rotary bolt 8 having a recess 8*a* designed to receive the lock pin 7 is rotatably arranged in connection with the elongated recess 6. In the position shown, the rotary bolt 8 is engaged with the catch 5 (FIG. 2*a*). This is intended to prevent the lock pin 7, when it is in the recess 8*a* of the rotary bolt, from leaving the recess 6 in the lock casing 2, thereby keeping the openable part of the vehicle locked in the vehicle.

A shaft 11 having a reversing arm 12 is rotatably fixed thereon is arranged in connection with the free end of the 4*a* of the cable pointing towards the lock casing 2. A mechanical actuating element (not shown), such as a central locking motor, is designed to impart a torsional movement to the reversing arm 12 about the shaft 11 between a locked position (FIG. 2*a*) and an unlocked position (FIG. 2*b*).

On the reversing arm 12 in connection with the shaft 11 there is an element 13 designed, when the reversing arm 12 rotates, to act upon the free cable end 4*a* pointing towards the lock casing 2 in the direction of the shaft 11. The element 13 can be designed, for example, as a radially elongated recess arranged perpendicular to the axis of rotation 11, through which recess the cable end 4*a* passes. When the reversing arm 12 rotates, the element 13 will move around the cable 4 between position A, as in FIG. 2*a* and position B shown diagrammatically in FIG. 2*b*.

The cable sheath 3 is fixed to the lock casing 2 at an angle to the shaft 11 of the reversing arm 12. When the reversing and 12 rotates between the unlocked position (FIG. 2*b*) and the locked position (FIG. 2*a*), the actuating element 13 causes the free cable end 4*a* pointing towards the lock casing 2 to be displaced in the direction of the shaft 11.

By designing the actuating element 13 as a radially elongated recess arranged perpendicular to the axis of rotation of the shaft 11, it can be ensured that the cable end 4*a* does not come into radial contact with the actuating element 13 when the reversing arm 12 rotates. This means that any force which might give rise to a torque on the reversing arm 12 about the shaft 11 thereof will not be transmitted from the cable end 4*a* to the reversing arm 12 by way of the actuating element 13 when the actuating element 13 is shifted between positions A and B.

A cable seat 10 can be integrally formed with the catch 5. The cable seat 10 can also be formed on a moveable part operatively connected to the catch 5. When the cable 4 is pushed down in the cable sheath 3, the free cable end 4*a* pointing towards the lock casing 2 will be displaced out of that end 3*a* of the cable sheath fixed to the lock casing. When the reversing arm 12 is in the unlocked position 14*a*, the actuating element 13 directs the cable end 4*a* for engagement with the cable seat 10. By further displacing the cable 4, the cable seat 10 takes up the free end 4*a* of the cable and imparts a torsional movement to the catch 5. The catch 5 is disengaged from the rotary bolt 8, thereby releasing the bolt 8. Once released, a torsional movement can be imparted to the rotary bolt 8 allowing the locking pin 7 to leave the recess 6 in the lock casing 2.

As the actuating element 13 is moved about the shaft 11 of the reversing arm 12 into the locked position 14*b*, the free end 4*a* of the cable pointing towards the lock casing 2 is deflected in the direction of the shaft 11. Because the deflection of the cable end 4*a* occurs only in the direction of the shaft 11 and because the cable end 4*a* does not act upon the actuating element 13 in a radial direction, any forces that might generate torque counteracting the rotation of the reversing arm 12 between the unlocked position 14*a* and the locked position 14*b* will thereby not be transmitted from the cable 4 to the reversing arm 12. Due to the axial deflection, the cable end 4*a* in the locked position 14*b* is oriented in such a way that the cable end 4*a* is directed to the side of the cable seat 10 when it is forced out of that end of the cable sheath 3 fixed in the lock casing 2. This can occur, for example, when acted upon by a door handle pushing down the other end of the cable 4 in the cable sheath 3. Since the cable seat 10 is not acted upon, the catch 5 and, therefore the rotary bolt 8, remain unaffected, and the lock pin 7 of the openable part of the vehicle remain locked in the recess 6 of the lock casing.

It will be obvious to one skilled in the art that the element for actuation of the free cable end 4*a* pointing towards the lock casing can be designed in a number of alternative ways while still retaining the positive characteristics according to the invention. For example. in the embodiment according to FIGS. 1*a*, and 1*b*, the actuating element may be an electrical, pneumatic or hydraulic operating device. In the embodiment according to FIGS. 2*a*, and 2*b*, the actuating element may be designed as a loop or the like that is fixed to the reversing arm 12. A thermal, magnetic, electrochemical or piezoelectric operating device or an operating device that uses a memory metal may also be used as operating device.

While there has been disclosed effective and efficient embodiments of the invention using specific terms, it should be well understood that the invention is not limited to such embodiments as there might be changes made in the arrangement, disposition, and form of the parts without departing from the principle of the present invention as comprehended within the scope of the accompanying claims.

The invention claimed is:

1. A lock assembly which prevents a vehicle door from being opened by securing a vehicle door element, the lock assembly comprising:

a movable bolt, wherein the bolt secures the vehicle door element to prevent the door from being opened when the bolt is in a locked position and wherein the bolt allows the vehicle door element to be removed from the lock assembly, thereby enabling the vehicle door to be opened, when the bolt is in an unlocked position;

a catch that moves relative to the bolt, wherein the catch prevents the bolt from moving from the bolt's locked position to the bolt's unlocked position when the catch is in a locked position and wherein the catch allows the bolt to move from the bolt's locked position to the bolt's unlocked position when the catch is in an unlocked position;

a cable seat operatively connected to the catch, the cable seat being configured to transmit force applied to it to the catch so as to move the catch from its locked position to its unlocked position;

a cable having a free end and supported in a manner which permits the free end to move generally toward the cable seat; and a cable-positioning operating device having a locked position and an unlocked position;

wherein the cable seat, the cable, and the cable-positioning operating device are mutually arranged and configured such that 1) when the cable-positioning operating device is in its unlocked position, longitudinal movement of the cable toward the cable seat brings the free end of the cable into engagement with the cable seat, whereby the catch is caused to move from its locked position to its unlocked position so that the bolt can be moved from its locked position to its unlocked position; and 2) when the cable-positioning operating device is in its locked position, the free end of the cable does not engage the cable seat upon longitudinal movement of the cable generally toward the cable seat.

2. The lock assembly of claim 1, wherein the catch is caused to move from its locked position to its unlocked position by continued longitudinal movement of the cable after the free end of the cable contacts the cable seat.

3. The lock assembly of claim 1, wherein movement of the cable-positioning operating device from its locked position to its unlocked position effects lateral deflection of the free end of the cable.

4. The lock assembly of claim 1, wherein the bolt pivots.

5. The lock assembly of claim 1, wherein the catch pivots.

6. The lock assembly of claim 1, wherein the cable seat is part of the catch.

7. The lock assembly of claim 1, wherein the cable is supported within a sheath and the free end of the cable extends out of the sheath.

8. The lock assembly of claim 1, wherein the cable-positioning operating device is an electrically, pneumatically, hydraulically, thermally, magnetically, electrochemically, or piezoelectrically operated device.

9. The lock assembly of claim 1, wherein the cable-positioning operating device is a mechanically operated device.

10. The lock assembly of claim 1, wherein the cable is connected to the cable-positioning operating device.

11. The lock assembly of claim 1, wherein the cable-positioning operating device reciprocates linearly between its locked and unlocked positions.

12. The lock assembly of claim 1, wherein the cable-positioning operating device pivots between its locked and unlocked positions.

13. The lock assembly of claim 12, wherein the cable-positioning operating device has a loop through which the free end of the cable passes, whereby pivoting of the cable-positioning operating device changes the orientation of the free end of the cable vis-à-vis the cable seat.

* * * * *